US005326194A

United States Patent [19]

Pinto et al.

[11] Patent Number: 5,326,194

[45] Date of Patent: Jul. 5, 1994

[54] DEVICE AND METHOD FOR PNEUMATICALLY FEEDING A PLURALITY OF FEEDING CHUTES

[75] Inventors: Akiva Pinto, Duesseldorf-Wittlaer; Guenter Lucassen, Haltern; Reinhard Schmidt, Gescher, all of Fed. Rep. of Germany

[73] Assignee: Hergeth Hollingsworth GmbH, Duelman, Fed. Rep. of Germany

[21] Appl. No.: 948,601

[22] Filed: Sep. 23, 1992

[30] Foreign Application Priority Data

Sep. 25, 1991 [DE] Fed. Rep. of Germany ..... 4131758

[51] Int. Cl.[5] ..... B65G 53/06

[52] U.S. Cl. ..... 406/13; 406/156; 406/183

[58] Field of Search ..... 406/155, 156, 181, 183, 406/1, 3, 106, 11, 13, 28

[56] References Cited

U.S. PATENT DOCUMENTS 3,408,115 10/1968 Reiterer .
3,414,330 12/1968 Trutzschler ..... 406/156 X
4,045,091 8/1977 Beneke .
4,175,893 11/1979 Vollrath et al. ..... 406/156 X
4,648,754 3/1987 Staheli et al. ..... 406/156

FOREIGN PATENT DOCUMENTS 1510370 6/1973 Fed. Rep. of Germany .
800065 1/1981 U.S.S.R. ..... 406/183

*Primary Examiner*—David M. Mitchell
*Assistant Examiner*—Gary C. Hòge
*Attorney, Agent, or Firm*—Leatherwood Walker Todd & Mann

[57] ABSTRACT

A device and method for pneumatically feeding fiber flocks into a plurality of feeding chutes of fiber processing machines connected with at least one distributing line, the feeding being effected through a fiber and transport air flow, characterized in that the distributing line is a formed by a closed circular line (4) into which a first transport line section (6) opens for feeding in fiber flocks, and that, at the end of the first transport line section (6), the fiber and transport air flow may be switched selectively into the one or the other direction of the circular line (4) through a switching means (8).

12 Claims, 2 Drawing Sheets

DEVICE AND METHOD FOR PNEUMATICALLY FEEDING A PLURALITY OF FEEDING CHUTES

BACKGROUND OF THE INVENTION

The present invention is directed to a device for pneumatically feeding fiber flocks into a plurality of feeding chutes of fiber processing machines, as well as to a method for pneumatic feeding.

Such devices are known, for example, from German Patent 15 10 370, wherein a distributing line supplies fiber flocks to a plurality of spinning preparation machines and wherein the distributing line ends after a certain number of feeding chutes (dead-end). It is a problem of such distributing lines that it is practically impossible to set the velocity of the transport air such that all feeding chutes connected to the distributing line are fed with fiber flocks in the same way. With too high velocities of the transport air, the supply of fiber flocks to the feeding chutes is insufficient, whereas velocities that are too low entail the risk of clogging, in particular at branches.

German Laid Open 22 42 038 describes a plurality of parallel distributing lines that may simultaneously be charged with different kinds of fiber material, a device being provided at the head of each feeding chute via which, when all feeding lines are operated at the same time, each individual chute roller may be connected with one of the three feeding lines. The respective feeding lines may be charged from different ends so that two or more dead end lines are provided extending in different directions. It is a drawback of this arrangement that each feeding chute has to be connected with two or more distributing lines and that each feeding chute must be provided with a switching means.

From European Patent 0 175 056, a distributing line with a closed end is known, wherein the air velocity is controlled through throttle means. These throttle means are also suitable for blocking the distributor line at any place between two chutes so that two dead end distributing lines may be obtained. This pneumatic transport device for fiber flocks may also be adapted for an oppositely directed flock transport in the transport channel, due to the throttle means being adjustable to both flow directions in the transport channel.

SUMMARY OF THE INVENTION

It is the object of the present invention to provide a device, as well as a method for pneumatically feeding a plurality of fiber processing machines that allow for a more uniform packing of the fiber flocks in the feeding chutes of the fiber processing machines, while simultaneously reducing the risk of clogging.

The object is solved with the features of the claims.

The invention provides that the distributing line is formed of a closed circuit or loop, referred to herein as a circular line into which a transport line opens, and that the flow of transport air may be selectively switched from the one direction of the circular line to the other by means of a deflecting means.

Such a circular line reduces the risk of clogging substantially and levels the compression of fiber flocks in the feeding chutes of the fiber processing machines. The circular line with a switching, or deflecting, means at the end of the transport line allows intermittent switches between clockwise and counter-clockwise feeding into the circular line so that, alternatingly, a dead end line is formed, respectively. The feeding chute that has been fed first in the one flow direction, will be fed last when the flow direction is switched to the opposite. A feeding chute in the middle of the circular line is filled in the same way in both flow directions.

Thus, feeding chutes arranged at one end of the circular line will receive more flock material in the one flow direction and less flock material in the other flow direction, yet, in average, they receive the same amount as a feeding chute situated in the middle of the circular line. In a particularly advantageous manner, this allows to achieve a uniform compression of the fiber flocks in the feeding chutes over the entire row of feeding chutes so that the individual fiber processing machines are supplied with fiber flocks that are compressed alike. The intermittent switching of the flow direction offers the further advantage of counteracting a separation of the fiber flocks resulting from different aerodynamic characteristics.

It is an advantage of this way of feeding flocks that the number of feeding and filling chutes connected can be much greater than with the conventional dead end solution.

Beyond the deflecting means, the circular line consists of two transport line sections projecting in substantially opposite directions and being interconnected through a feeding line section with filling chutes. The transport line sections without connections to filling chutes allow an acceleration of the fiber and transport air flow to a certain minimum velocity, before the filling chutes are fed.

At the end of each transport line section a branching means may be provided to which a plurality of feeding line sections switched in parallel may be connected. In this way, the number of the feeding chutes that may be connected can again be increased.

The branching means may have shutter means for individual feeding line sections, by which certain feeding line sections may be blocked.

The transport air flow may be switched after short periods, e.g. every time the fiber and transport air flow reaches the respective dead end of the unilaterally blocked circular line or upon a corresponding change in pressure in the transport line section serving as the dead end or by means of light barriers in the dead end area. Feeding the fiber flocks into the unilaterally closed circular line and the interval-like switching of the fiber/transport air flow in alternating opposite flow directions of the circular line, the circular line being shut off in different end sections, offer the advantage that the fiber flocks are fed into the feeding chutes with a greater uniformity, thereby also reducing the effect of the separation of fiber flocks in longer transport lines resulting from different flow velocities of the fiber flocks.

The following is a detailed description of an embodiment of the present invention with reference to the drawings.

DESCRIPTION OF A PREFERRED EMBODIMENT

Figure 1:
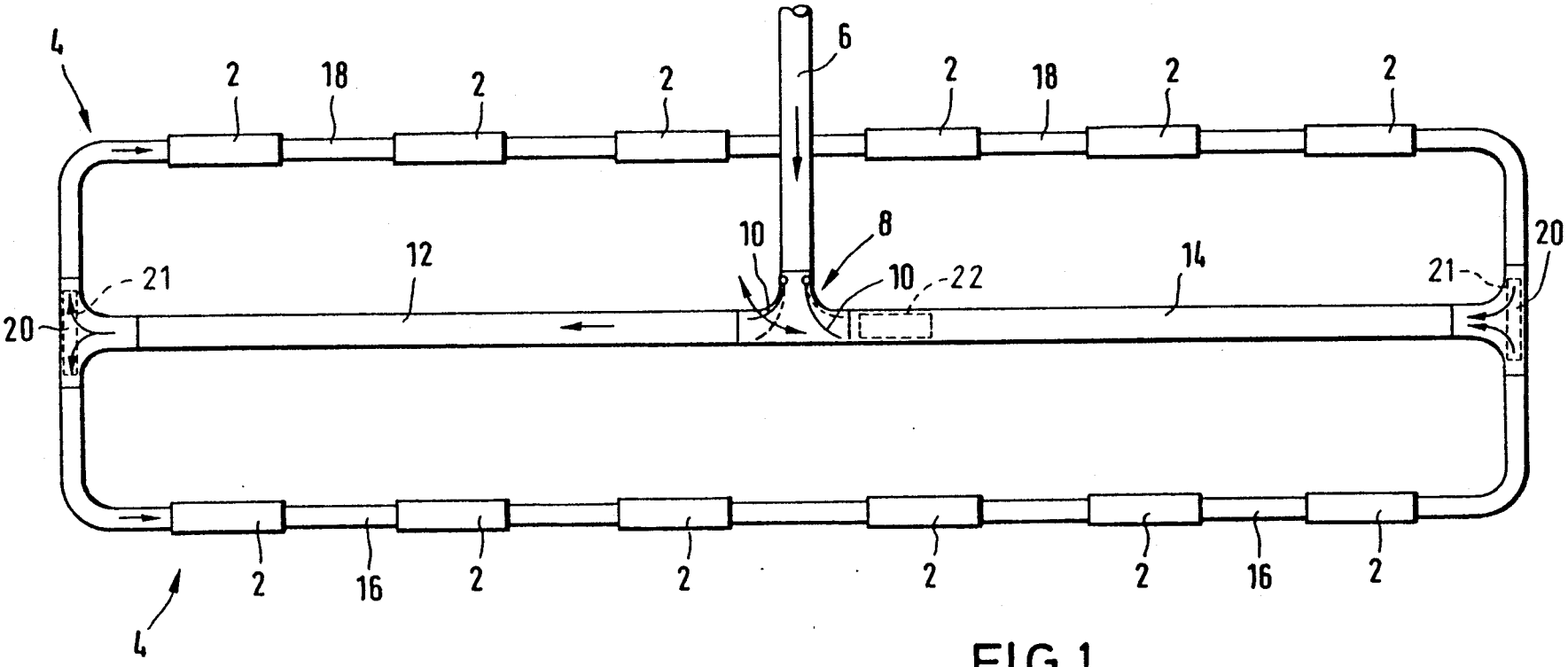
FIG. 1 illustrates the device for pneumatically feeding a plurality of feeding chutes in accordance with the invention with two feeding lines.
Figure 2:
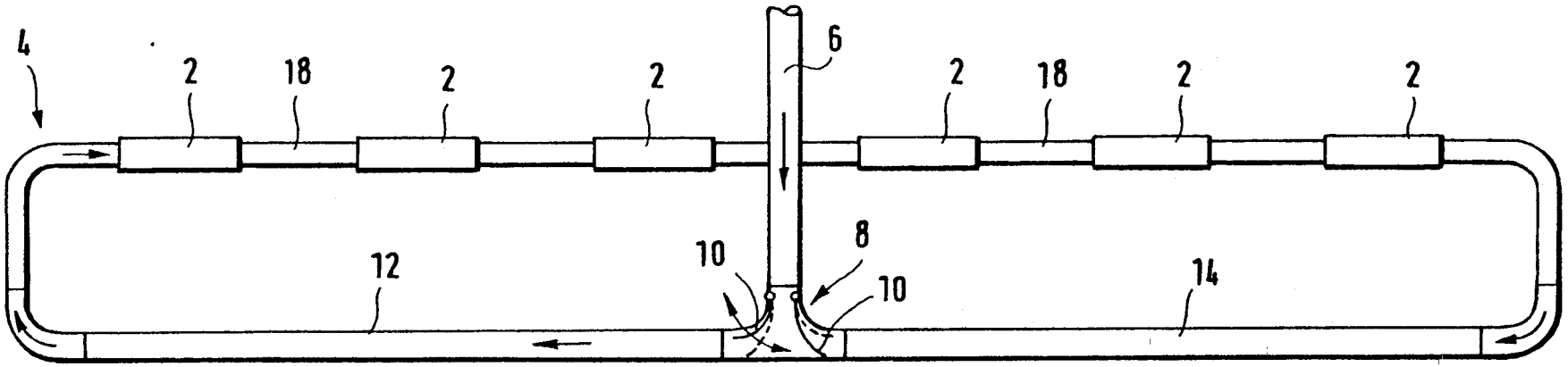
FIG. 2 illustrates the device for pneumatically feeding a plurality of feeding chutes in accordance with the present invention with one feeding line.

The device for pneumatically feeding a plurality of feeding chutes 2 comprises a distributing line composed of a closed circuit or loop, referred to herein as circular line 4, into which a first transport line section 6 opens. At the end of the first transport line section 6, a switching means 8 is provided that can feed the fiber and transport air flow into the circular line 4 in substantially opposite flow directions. To this avail, the deflecting, or switching, means 8 has at least one, preferably two, motor-operated control flaps 10 that keep the circular line 4 open to the one side, yet shut it off to the other side.

In both flow directions of the circular line 4 a second and a third transport line section 12, 14 are provided following the switching means 8, the sections being connected to the respective other transport line section 14, 12 through a feeding line section 16, 18, while they are shut off from each other by the switching means 8.

In the feeding line section 16, 18, a plurality of filling chutes 2, arranged successively in the flow direction of the fiber and transport air flow, are provided into which the fiber flocks contained in the fiber and transport air flow are fed.

Adjoining the rear end ends of the feeding line sections 16, 18 are the second and third transport line sections 12, 14. Transport line sections 12, 14 are selectively closed at their ends opposite to their respective joining to the feeding line sections 16, 18 by means of the control flap 10 of the switching means 8, thereby forming a dead end line.

In the distributing line illustrated by the embodiment, two circular lines 4 are depicted that may be fed by means of a branching means 20 so as to obtain two dead end lines and to thereby increase the number of connectable filling chutes 2.

The branching means 20 may be provided with shutter means, generally 21, to selectively shut off a filling chute row and to block the supply of flocks to this row of filling chutes.

Differing from the illustration in the Figures the branching means 20 may also interconnect more than parallel feeding line sections 16, 18.

The control of the pneumatic feeding of fiber flocks may switch the flow direction of the fiber and transport air flow, for example, through use of control means 22 (being shown, for example, in transport line section 14) dependent on measuring signals, e.g. optical or pneumatical measured values, representing the flow velocity and the static pressure of the fiber and transport air flow or the presence of fiber flocks, in a predetermined section of the circular line, preferably in the second transport line section 12 or the third transport line section 14, respectively.

The switching may also be triggered at predetermined time intervals or in dependence on unusual operating conditions fixed according to defined criteria, e.g. if a tendency towards clogging is determined by means of sensors.

We claim:

1. An apparatus for pneumatically feeding fiber flocks for use by fiber processing machines through a fiber and transport air flow, the apparatus comprising:

a plurality of feeding chutes for receiving fiber flocks and for delivering the fiber flocks to the fiber processing machines;

a closed circuit loop distributing line connected to each of said plurality of feeding chutes for transporting fiber flocks to said plurality of feeding chutes;

a first transport line section connected to said closed circuit loop distributing line for delivering fiber flocks to said closed circuit loop distributing line;

switching means associated with said first transport line section for selectively switching the direction of delivery of fiber flocks delivered by said first transport line section into one of at least two directions in said closed circuit loop distributing line, for allowing substantially uniform accumulation of fiber flocks from said first transport line to within said plurality of feeding chutes, through introduction of fiber flocks into each of said fiber feeding chutes from alternatingly different directions of said closed circuit loop distributing line;

said closed circuit loop distributing line including a second transport line section and a third transport line section each being connected to said switching means and extending in each of said at least two directions, respectively, of said closed circuit loop distributing line;

a plurality of feeding line sections; at least one of said feeding line sections being connected to at least one said fiber feeding chute and to at least one of said second and third transport line sections; and said closed circuit loop distributing line further including branching means arranged at the end of at least one of said second and said third transport line sections for connection to at least two of said feeding line sections.

2. The device of claim 1, wherein said branching means includes shutter means for at least one of said feeding line sections.

3. The device of claim 1, further comprising control means for controlling the pneumatic feeding of fiber flocks such that the flow direction of said fiber and transport air flow is dependent on measuring signals representing the flow velocity of said fiber flocks and transport air flow in a predetermined section of said closed circuit loop distributing line.

4. The device of claim 1, further comprising control means for controlling the pneumatic feeding of fiber flocks such that the flow direction of said fiber and transport air flow is dependent on measuring signals representing the pneumatic pressure of said fiber and transport air flow in a predetermined section of said closed circuit loop distributing line.

5. The device of claim 1, further comprising control means for controlling the pneumatic feeding of fiber flocks such that the flow direction of said fiber and transport air flow is dependent on measuring signals representing the presence of fiber flocks in a predetermined section of said closed circuit loop distributing line.

6. A method for feeding fiber flocks, carried in a fiber and transport air flow, into a plurality of filling chutes of fiber processing machines via at least one distributing line, comprising:

feeding said fiber flocks into a closed circuit loop distributing line from a transport line;

switching said fiber and transport air flow at intervals between alternatingly opposite flow directions in said closed circuit loop distributing line by alternatingly deflecting said fiber and transport air flow in said closed circuit loop distributing line to different sections of said closed circuit loop distributing line; and selectively directing the delivery of fiber flocks from said transport line section for allowing the fiber and air transport air flow to carry fiber flocks from said transport line section in one of at least two directions in said closed circuit loop line for allowing substantially uniform accumulation of fiber flocks within each of said plurality of fiber feeding chutes through introduction of fiber flocks into each of said fiber feeding chutes from alternatingly different directions of said closed circuit loop.

7. The method of claim 6, wherein after deflecting said fiber and transport air flow in said different sections of said closed circuit loop line, feeding the fiber flocks into said filling chutes in a central portion of said closed circuit loop line only.

8. The method of claim 7, further comprising directing said fiber and transport air flow into a plurality of parallel feeding line sections.

9. The method of claim 6, wherein said deflecting further comprises a respective deflecting of said fiber and air transport flow in dependence on predetermined limit values of the flow velocity and the pressure of said fiber and transport air flow.

10. The method of claim 6, wherein said deflecting further comprises a respective deflecting of said fiber and air transport flow in dependence on predetermined limit values of the flow velocity.

11. The method of claim 6, wherein said deflecting further comprises a respective deflecting of said fiber and air transport flow in dependence on predetermined limit values of the pressure of said fiber and transport air flow.

12. The method of claim 6, wherein said deflecting further comprises a respective deflecting of said fiber and air transport flow in dependence on predetermined limit values of the detection of the amount of said fiber flocks in said fiber and air transport flow.

* * * * *